US008689596B2

(12) United States Patent
Katagiri et al.

(10) Patent No.: US 8,689,596 B2
(45) Date of Patent: Apr. 8, 2014

(54) KEY AND LOCK

(75) Inventors: Toshiharu Katagiri, Aichi (JP); Noriyasu Sakai, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 941 days.

(21) Appl. No.: 11/573,990

(22) PCT Filed: Sep. 21, 2005

(86) PCT No.: PCT/JP2005/017908

§ 371 (c)(1),
(2), (4) Date: Feb. 20, 2007

(87) PCT Pub. No.: WO2006/033454

PCT Pub. Date: Mar. 30, 2006

(65) Prior Publication Data

US 2009/0019904 A1 Jan. 22, 2009

(30) Foreign Application Priority Data

Sep. 21, 2004 (JP) ..... 2004-0274039

(51) Int. Cl.
*E05B 29/08* (2006.01)
*E05B 19/06* (2006.01)

(52) U.S. Cl.
USPC ..... 70/492; 70/406; 70/409

(58) Field of Classification Search
USPC ..... 70/256, 337, 340, 377, 405–409, 492
See application file for complete search history.

(56) References Cited

U.S. PATENT DOCUMENTS

| | | | | | |
|---|---|---|---|---|---|
| RE20,865 | E | * | 9/1938 | Olson | 70/406 |
| 2,155,734 | A | * | 4/1939 | Olson | 70/492 |
| 2,358,164 | A | | 9/1944 | Hünger | |
| 2,375,682 | A | * | 5/1945 | Olson | 70/492 |
| 2,829,513 | A | * | 4/1958 | Fresard et al. | 70/492 |
| 3,263,461 | A | * | 8/1966 | Tartaglia | 70/492 |
| 3,509,749 | A | * | 5/1970 | Arzig et al. | 70/492 |
| 4,356,713 | A | | 11/1982 | Widen | |
| 4,453,432 | A | | 6/1984 | Widen | |

(Continued)

FOREIGN PATENT DOCUMENTS

| | | | |
|---|---|---|---|
| CH | 282020 | | 4/1952 |
| DE | 2824809 | A1 | 12/1979 |

(Continued)

*Primary Examiner* — Christopher Boswell
(74) *Attorney, Agent, or Firm* — Seager, Tufte & Wickhem LLC

(57) ABSTRACT

A thin key that is thin but includes serrations on each of two opposite sides of a blade (42, 72). The key is associated with a cylinder lock including a rotor (13) with tumblers (21-28) retained in the rotor. The blade, which is for insertion into the rotor of the cylinder lock, includes opposite first and second wide sides (F1, F3; F2, F4) and opposite first and second narrow sides (51, 74; 52, 75). A first notch (54, 76) is formed in the first wide side and a second notch (64, 86) is formed in the second wide side. The first and second notches each have a serrated wall (54*a*, 76*a*; 64*a*, 86*a*) engageable with the tumblers. The first notch and the second notch are spaced apart so that they do not overlap each other. The sum of the depths of the first and second notches (L1, D1; L2, D2) is greater than or equal to the thickness of the blade (L3, D3).

6 Claims, 4 Drawing Sheets

(56) References Cited

U.S. PATENT DOCUMENTS

| | | | | |
|---|---|---|---|---|
| 4,964,288 | A | 10/1990 | Braun | |
| 5,372,024 | A * | 12/1994 | Ruckert | 70/406 |
| 6,041,631 | A * | 3/2000 | Vonlanthen | 70/492 |
| 6,308,543 | B1 * | 10/2001 | Yoshizawa | 70/492 |
| 6,427,506 | B1 * | 8/2002 | Prunbauer | 70/495 |
| 6,968,717 | B2 * | 11/2005 | Suzuki et al. | 70/492 |
| 7,424,815 | B1 * | 9/2008 | Pagnoncelli | 70/492 |
| 7,484,392 | B2 * | 2/2009 | Katagiri | 70/492 |

FOREIGN PATENT DOCUMENTS

| | | | |
|---|---|---|---|
| EP | 0356032 | A2 | 2/1990 |
| GB | 2118620 | A | 11/1983 |
| JP | 56-16779 | A | 2/1981 |
| WO | 2004048724 | A1 | 6/2004 |

* cited by examiner

KEY AND LOCK

FIELD OF THE INVENTION

The present invention relates to a key formed from a metal plate or the like and to a lock associated with such a key.

BACKGROUND OF THE INVENTION

Japanese Laid-Open Patent Publication No. 56-16779 describes a key for insertion into an associated cylinder lock. When the proper key is inserted in the cylinder lock, the key and the cylinder lock are engaged with each other so as to satisfy a predetermined concavo-convex relationship. This enables the turning of the key to, for example, open the lock. Such a key (hereafter, referred to as the first key) has a blade. One side of the blade has a wall functioning as a guide for guiding the insertion of the blade into the cylinder lock. The other side of the blade includes an engaging portion for engaging tumblers in the cylinder lock. Serrations are formed along the engaging portion. The serrations are formed to engage the tumblers and satisfy the predetermined concavo-convex relationship when the key is inserted into the cylinder lock. The first key is difficult to duplicate due to the wall provided on one side of the blade. However, the first key must always be inserted into the cylinder lock with the wall facing the same direction. In other words, the first key is irreversible.

FIGS. 7A and 7B show another known key (hereafter, referred to as the second key 101) for insertion into an associated cylinder lock. The turning of the second key 101 is enabled when the second key 101 and the cylinder lock are engaged with each other so as to satisfy a predetermined concavo-convex relationship. The second key 101 includes a groove 103 formed in each side of a blade 102. Serrations 104 are formed along the walls defining each groove 103. The groove 103 and serrations 104 on one side of the blade 102 are symmetric to the groove 103 and serrations 104 on the other side of the blade 102. Thus, the second key 101 is reversible.

In the second key 101, a wall 105 extends between the bottom portions of the two grooves 103. The wall 105 makes it difficult to duplicate the second key 101. However, the wall 105 increases the thickness of the blade 102.

SUMMARY OF THE INVENTION

It is an object of the present invention to provide a key that is thin but includes serrations on each of two opposite sides of a blade.

One aspect of the present invention is a key for insertion into an associated cylinder lock including a rotor and a plurality of tumblers retained in the rotor. The key includes a blade insertable into the rotor of the cylinder lock. The blade has a thickness and a width. The blade includes a first wide side, a second wide side located opposite to the first wide side in a thicknesswise direction of the blade, a first narrow side connecting the first and second wide sides, and a second narrow side located opposite to the first narrow side in a widthwise direction of the blade and connecting the first and second wide sides. A first notch is formed in the first wide side near the first narrow side and extends in an insertion direction of the blade. The first notch has a depth in the thicknesswise direction and is defined by a serrated wall and a bottom wall. The serrated wall of the first notch is engageable with the tumblers retained in the rotor of the cylinder lock. A second notch is formed in the second wide side near the second narrow side and extends in the insertion direction of the blade. The second notch has a depth in the thicknesswise direction and is defined by a serrated wall and a bottom wall. The serrated wall of the second notch is engageable with the tumblers retained in the rotor of the cylinder lock. The first notch and the second notch are spaced apart from each other in the widthwise direction, and a sum of the depth of the first notch and the depth of the second notch is greater than or equal to the thickness of the blade.

Another aspect of the present invention is a lock including a cylinder having a slot. A rotatable rotor is received in the cylinder. A plurality of movable tumblers retained in the rotor. A plurality of springs are retained in the rotor for urging the tumblers to project out of the rotor and into the slot of the cylinder. A key includes a blade insertable into the rotor. The blade has a thickness and a width. The blade includes a first wide side, a second wide side located opposite to the first wide side in a thicknesswise direction of the blade, a first narrow side connecting the first and second wide sides, and a second narrow side located opposite to the first narrow side in a widthwise direction of the blade and connecting the first and second wide sides. A first notch is formed in the first wide side near the first narrow side and extends in an insertion direction of the blade. The first notch has a depth in the thicknesswise direction and is defined by a serrated wall and a bottom wall. The serrated wall of the first notch is engageable with the tumblers and shaped to move the tumblers out of the slot and into the rotor against the force of the springs when engaged with the tumblers during insertion of the blade into the rotor. A second notch is formed in the second wide side near the second narrow side and extends in the insertion direction of the blade. The second notch has a depth in the thicknesswise direction and is defined by a serrated wall and a bottom wall. The serrated wall of the second notch is engageable with the tumblers and shaped to move the tumblers out of the slot and into the rotor against the force of the springs when engaged with the tumblers during insertion of the blade into the rotor. The first notch and the second notch are spaced apart from each other in the widthwise direction. A sum of the depth of the first notch and the depth of the second notch is greater than or equal to the thickness of the blade.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A first embodiment of the present invention will now be discussed with reference to FIGS. 1 to 5.

Figure 1A:
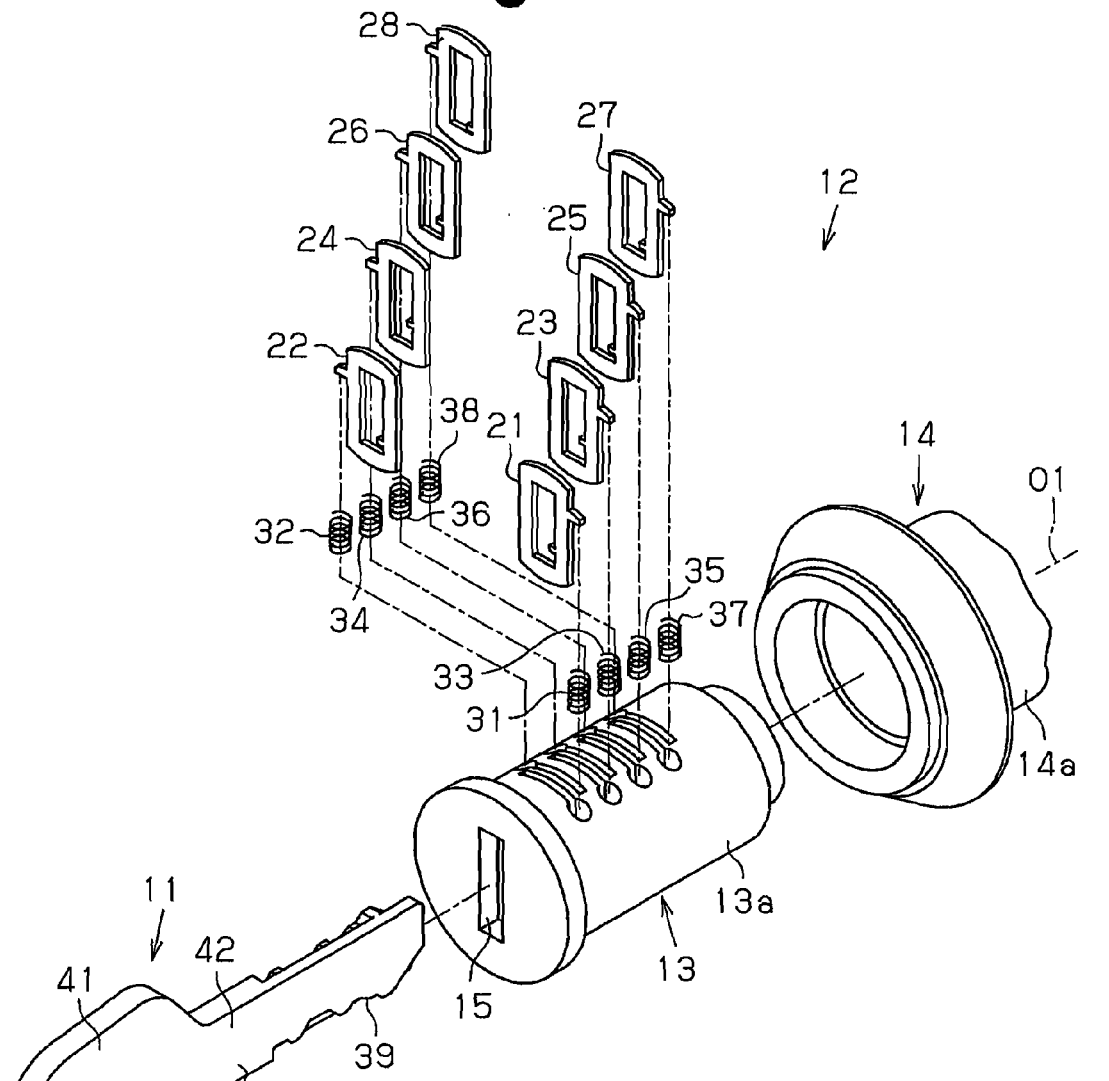
FIG. 1A is an exploded perspective view showing a cylinder lock and a key according to a first embodiment of the present invention.

Referring to FIG. 1A, a key 11 cooperates with a cylinder lock 12 to perform locking and unlocking. The cylinder lock 12 includes a rotor 13 and a rotor case 14. The rotor case 14 is fixed to a support (not shown) and includes a cylinder 14*a*, which rotatably receives the rotor 13. A key hole 15, into which the key 11 is inserted, is formed in the rotor 13.

Eight plate tumblers 21, 22, 23, 24, 25, 26, 27, and 28 are retained in the rotor 13. Further, springs 31, 32, 33, 34, 35, 36, 37, and 38 respectively corresponding to the plate tumblers 21-28 are retained in the rotor 13. The springs 31-38 urge the corresponding plate tumblers 21-28 so as to project from the outer surface 13*a* of the rotor 13. The plate tumblers 21-28 are urged upward as viewed in FIG. 2.

Figure 1B:
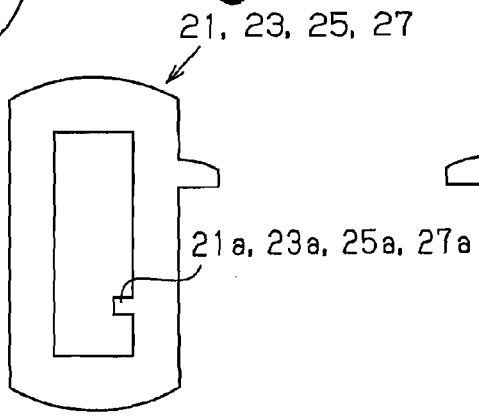
FIGS. 1B and 1C are front views each showing a plate tumbler.
Figure 1C:
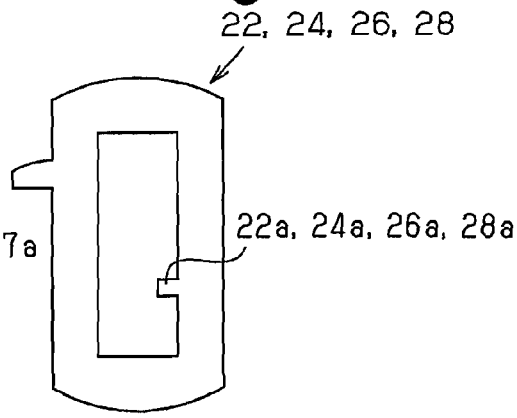

The key 11 includes first serrations 39. As shown in FIGS. 1B and 1C, the plate tumblers 21-28 respectively have projections 21*a*, 22*a*, 23*a*, 24*a*, 25*a*, 26*a*, 27*a*, and 28*a* that engage the first serrations 39 of the key 11.

Figure 2:
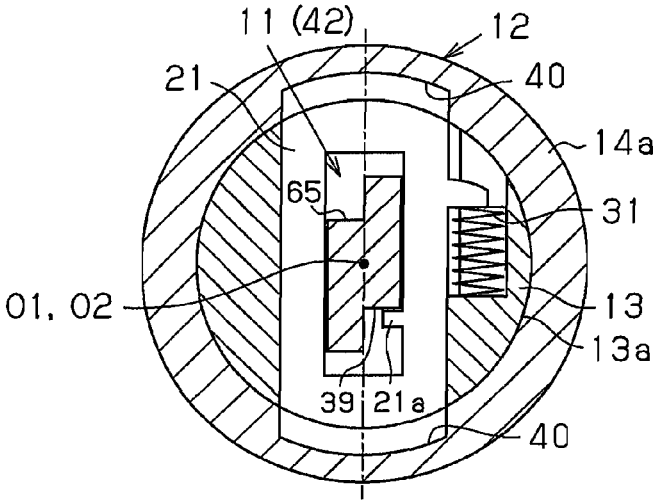
FIG. 2 is a cross-sectional view of the cylinder lock shown in FIG. 1A.
Figure 3A:
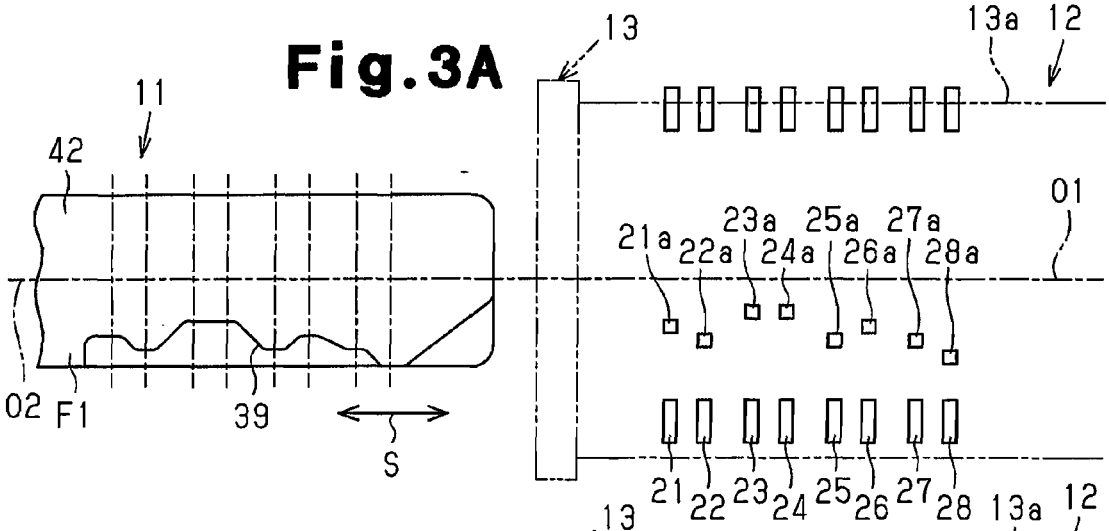
FIGS. 3A and 3B are schematic diagrams showing the operation of the cylinder lock of FIG. 1A during insertion of the key.
Figure 3B:
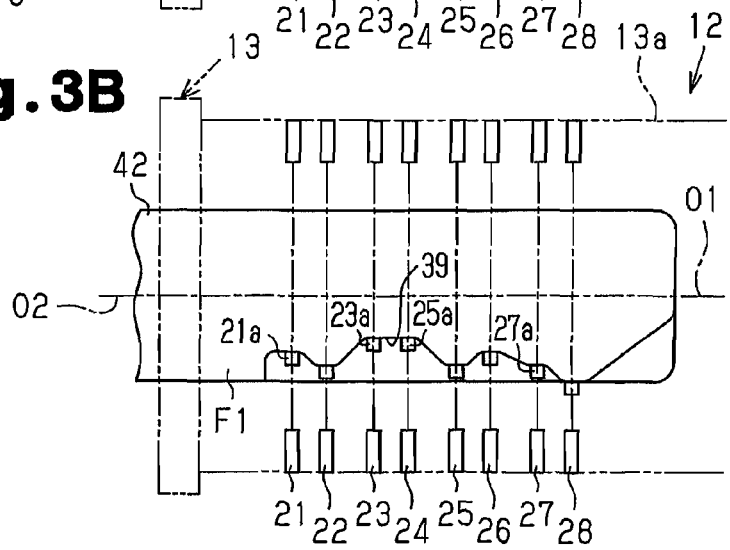

Referring to FIG. 2, the cylinder 14*a* includes an inner circumferential surface. Slots 40 are formed in the inner circumferential surface. The slots 40 extend parallel to the axis O1 of the rotor 13.

Referring to FIGS. 1, 2, 3A, and 3B, when the proper key 11 is inserted into the key hole 15 of the rotor 13, the first serrations 39 engage with the projections 21*a*-28*a*. This moves each of the plate tumblers 21-28 inward from the outer surface 13*a* of the rotor 13. As a result, the plate tumblers 21-28 are each disengaged from the slot 40 (in FIG. 2, the upper slot 40). In this state, the rotor 13 is rotatable relative to the cylinder 14*a*. Thus, key 11 may be turned to perform unlocking.

When an improper key is inserted into the key hole 15 of the rotor 13 or when no key is inserted into the key hole 15, at least one of the plate tumblers 21-28 project out of the outer surface 13*a* of the rotor 13 and engage with one of the slots 40. In this state, rotation of the rotor 13 relative to the cylinder 14*a* is disabled. Thus, the key 11 cannot be turned to perform locking.

The structure of the key 11 will now be described in detail.

Referring to FIG. 1A, the key 11 is formed from a plate of metal. The key 11 includes a grip 41 and a blade 42, which is integrally connected to the grip 41.

Figure 4A:
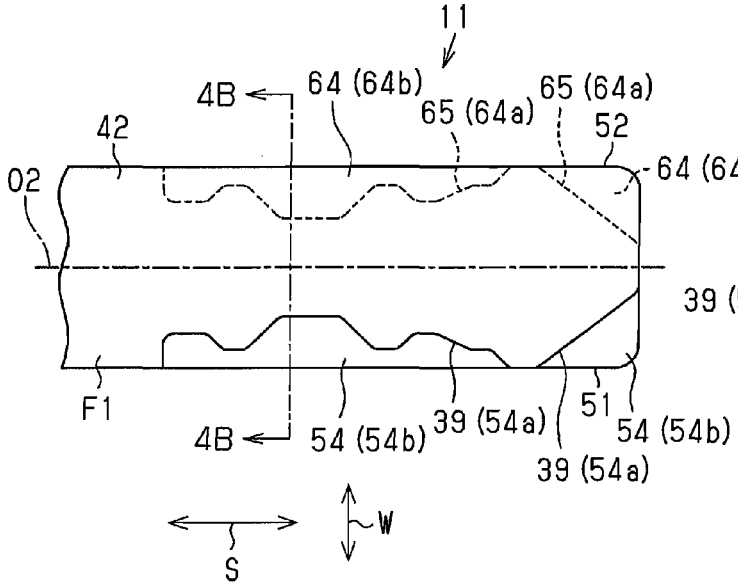
FIG. 4A is a front view showing a blade of the key of FIG. 1A.
Figure 4B:
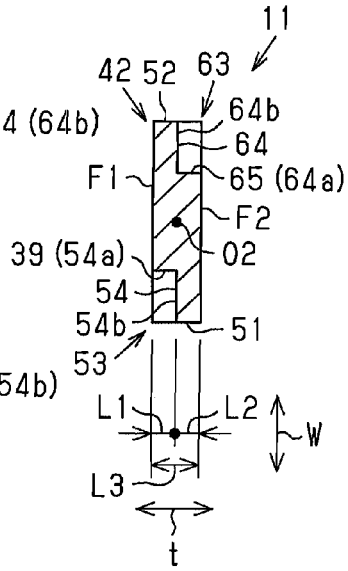
FIG. 4B is a cross-sectional view taken along line 4B-4B in FIG. 4A.

As shown in FIGS. 4A and 4B, the blade 42 is an elongated rectangular plate. In the widthwise direction W, the blade 42 has a first wide side F1 and an opposite second wide side F2. In the thicknesswise direction t, the blade 42 has a first narrow side 51 and an opposite second narrow side 52. The first and second narrow sides 51 and 52 connect the first and second wide sides F1 and F2.

A first corner 53 is defined between the first wide side F1 and the first narrow side 51. A first notch 54 is formed in the first corner 53. The first notch 54 extends in the direction the blade 42 is inserted into the key hole 15 (insertion direction S). A serrated wall 54*a* is formed in the first notch 54 so as to define first serrations 39. In this embodiment, the serrated wall 54*a* is formed so that the first notch 54 terminates at a certain position in the insertion direction S. However, depending on the key, the first notch 54 may terminate at more than one position in the insertion direction S or may not terminate at all. Even if the first notch 54 is terminated at a certain position, the serrated wall 54*a* at such a position would still function as part of the first serrations 39. Accordingly, the first serrations 39 extend continuously in the insertion direction S without any interruptions even if there is a termination of the first notch 54. The first notch 54 includes a bottom wall 54*b*, which is located at the middle of the blade 42 with respect to the thicknesswise direction t.

A second notch 64, which is symmetric to the first notch 54 about a center line O2, is formed in the blade 42. The center line O2 lies along the center of the blade 42 in the widthwise direction W and the thicknesswise direction t. A second corner 63 is defined between the second wide side F2 and the second narrow side 52. The second notch 64 is formed in the second corner 63. The second notch 64 extends in the insertion direction S. A serrated wall 64*a* is formed in the second notch 64 so as to define second serrations 65. In this embodiment, the serrated wall 64*a* is formed so that the second notch 64 terminates at a certain position in the insertion direction S. Even if the second notch 64 is terminated at a certain position, the serrated wall 64*a* at such a position would still function as part of the second serrations 65. Accordingly, the second serrations 65 extend continuously in the insertion direction S without any interruptions even if there is a termination of the second notch 64. The second notch 64 includes a bottom wall 64*b*, which is located at the middle of the blade 42 with respect to the thicknesswise direction t.

In this embodiment, the sum of the depth of the first notch 54 in the thicknesswise direction t (hereafter, referred to as dimension L1) and the depth of the second notch 64 in the thicknesswise direction t (hereafter, referred to as dimension L2) is equal to the thickness of the blade 42 (hereafter, referred to as dimension L3). When viewed from a direction perpendicular to the plane of FIG. 4A (i.e., the direction perpendicular to the first wide side F1), the first notch 54 and the second notch 64 do not overlap each other in the blade 42. That is, the first notch 54 and the second notch 64 are spaced apart in the widthwise direction W.

When forming keys for other cylinder locks, each key has first serrations 39 and second serrations 65 that are differently shaped from those of the key 11. If the key 11 and the cylinder lock 12 are associated with each other, the plate tumblers 21-28 are formed in correspondence with the shape of the first serrations 39 and second serrations 65. Accordingly, when the proper key 11 is inserted into the key hole 15 of the cylinder lock 12, the first serrations 39 or second serrations 65 engage and push the projections 21*a*-28*a* of the plate tumblers 21-28 against the force of the springs 31-38. This moves the plate tumblers 21-28 inward from the outer surface 13*a* of the rotor 13 so as to enable rotation of the rotor 13.

The key 11 of the first embodiment has the advantages described below.

(1) The first notch 54 and the second notch 64 are formed in opposite sides of the blade 42 of the key 11 so that they do not overlap one another when viewed from a direction perpendicular to the first wide side F1. Therefore, even though the key 11 is formed so that the sum of dimension L1 and dimension L2 is equal to dimension L3 as shown in FIG. 4B, the bottom wall 54*b* of the first notch 54 is separated from the bottom wall 64*b* of the second notch 64. If the first notch 54 were to be formed overlapping any portion of the second notch 64, this would form a hole extending through the blade 42 and lower the strength of the blade 42. However, this key 11 does not have such a problem. Accordingly, even though the serrations 39 and 65 are formed on two opposite sides of the blade 42, the blade 42 has a thickness that may be the same as that of a blade having a groove formed in only one of its sides (e.g., a key having only thickness m as shown in FIG. 7). Accordingly, the key 11 is thin even though it includes the serrations 39 and 65 in two opposite sides of the blade 42. Further, since the first notch 54 and the second notch 64 do not overlap each other, the blade 42 has relatively high strength.

(2) In the blade 42 of the key 11, the first notch 54 is formed in the first corner 53, and the second notch 64 is formed in the second corner 63. This enables the notches 54 and 64 to be spaced from each other while decreasing the dimension of the blade 42 in the widthwise direction W.

(3) In the blade 42 of the key 11, the first serrations 39 and the second serrations 65 are symmetric about center line O2. Thus, the blade 42 of the key 11 may be inserted into the key hole 15 regardless of the direction the blade 42 faces toward. In other words, it does not matter whether the serrations 39 engage the projections 21*a*-28*a* of the plate tumblers 21-28 or the serrations 65 engage the projections 21*a*-28*a*. Accordingly, the key 11 may be used in a reversible manner. This improves the convenience of the key 11 in comparison with a key that is irreversible.

(4) The two serrations 39 and 65 do not extend over the entire thickness of the blade 42. That is, in the key 11, the first serrations 39 are formed to extend along one half of the thickness of the blade 42, and the second serrations 65 are formed to extend along one half of the thickness of the blade 42. If the two serrations 39 and 65 were to be formed extending along the entire thickness of the blade 42, the key 11 may be easily duplicated by using a key cutter. However, when duplicating the key 11 of the first embodiment, the duplicate must be machined with an end mill. Accordingly, the key 11 of the first embodiment is difficult to duplicate.

(5) The two serrations 39 and 65 of the key 11 are formed so that they do not protrude from the corresponding narrow sides 51 and 52. Thus, the narrow sides 51 and 52 are mostly smooth. This improves the feel of the blade 42.

(6) In the key 11, the depth of the first notch 54 (first dimension L1) is equal to the depth of the second notch 64 (second dimension L2). This enables the first notch 54 and the second notch 64 to be formed symmetric about the center line O2.

A second embodiment of the present invention will now be described with reference to FIGS. 5A and 5B.

To avoid redundancy, like or same reference numerals are given to those components that are the same as the corresponding components of the first embodiment. Such components will not be described in detail.

In this embodiment, a key 71 has a blade 72 with flanges 87 and 88 formed on opposite sides of the blade 72 in the widthwise direction W. The flanges 87 and 88 extend in the insertion direction S.

Figure 5A:
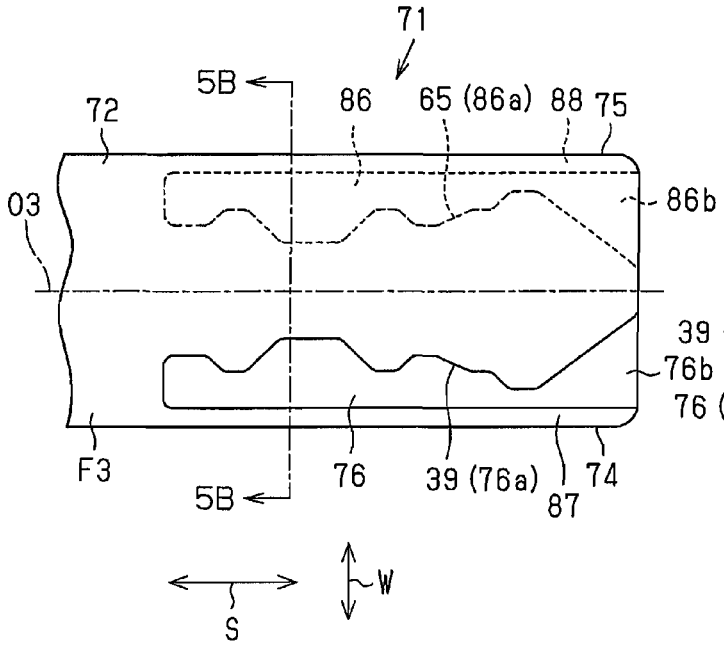
FIG. 5A is a front view showing a blade of a key according to a second embodiment of the present invention.
Figure 5B:
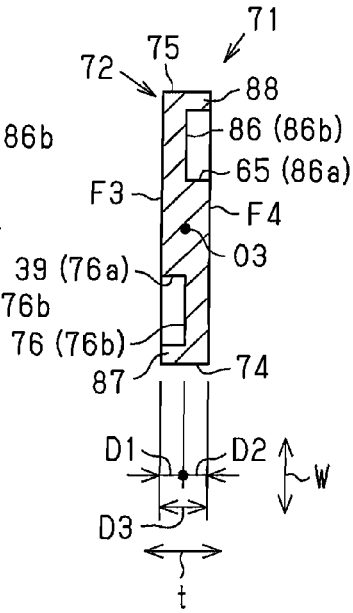
FIG. 5B is a cross-sectional view taken along line 5B-5B in FIG. 5A.

As shown in FIGS. 5A and 5B, the blade 72 of the key 71 is an elongated rectangular plate. In the widthwise direction W, the blade 72 has a first wide side F3 and an opposite second wide side F4. In the thicknesswise direction t, the blade 72 has a first narrow side 74 and an opposite second narrow side 75. A first notch 76, which extends in the insertion direction S of the blade 72, is formed in the first wide side F3 of the blade 72 at a location closer to the first narrow side 74 than the second narrow side 75. The first notch 76 includes a serrated wall 76*a* that defines first serrations 39 extending in the insertion direction S. The first notch 76 further includes a bottom wall 76*b*, which is located at the middle of the blade 72 with respect to the thicknesswise direction t.

A second notch 86, which is symmetric to the first notch 76 about a center line O3, is formed in the blade 72. The center line O3 lies along the center of the blade 72 in the widthwise direction W and the thicknesswise direction t. More specifically, a second notch 86, which extends in the insertion direction S of the blade 72, is formed in the second wide side F3 of the blade 72 at a location closer to the second narrow side 75 than the first narrow side 74. The second notch 86 includes a serrated wall 86*a* that defines second serrations 65 extending in the insertion direction S. The second notch 86 further includes a bottom wall 86*b*, which is located at the middle of the blade 72 with respect to the thicknesswise direction t.

In the key 71 of this embodiment, the sum of the depth of the first notch 76 in the thicknesswise direction t (hereafter, referred to as dimension D1) and the depth of the second notch 86 in the thicknesswise direction t (hereafter, referred to as dimension D2) is equal to the thickness of the blade 72 (hereafter, referred to as dimension D3). When viewed from a direction perpendicular to the plane of FIG. 5A (direction perpendicular to the first wide side F3), the first notch 76 and the second notch 86 do not overlap each other in the blade 42. That is, the first notch 76 and the second notch 86 are spaced apart in the widthwise direction W.

The flange 87 extends between the first notch 76 and the first narrow side 74 of the blade 72. Further, the flange 88 extends between the second notch 86 and the second narrow side 75 of the blade 72. Thus, a groove is defined in each side of the blade 72 by the flange 87 or the flange 88. Thus, the key 71 functions in the same manner as a key having grooves formed in two opposite sides of the blade.

In addition to advantages (1), (3), (4), and (6) of the key 11 of the first embodiment, the key 71 of the second embodiment has the advantages described below.

Figure 7A:
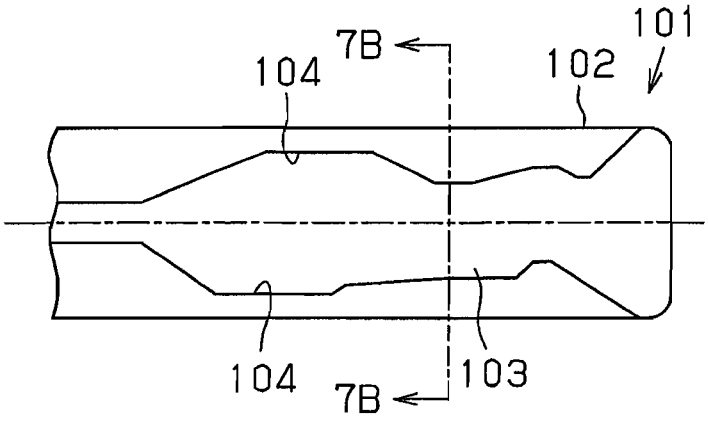
FIG. 7A is a front view showing a key of the prior art.
Figure 7B:
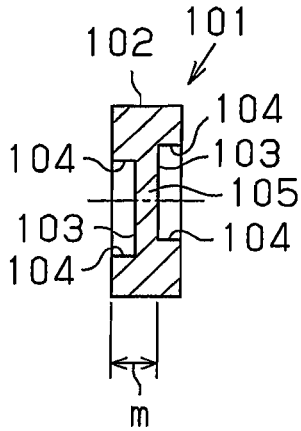
FIG. 7B is a cross-sectional view taken along line 7B-7B in FIG. 7A.

(1) The key 71 provides the same level of security and convenience as the second key 101 of the prior art shown in FIGS. 7A and 7B that has grooves formed in two opposite sides.

(2) The key 71 includes flanges 87 and 88 formed on opposite sides of the blade 72 in the widthwise direction W. Thus, the two serrations 39 and 65 do not protrude from the blade 72. This improves the feel of the blade 72.

It should be apparent to those skilled in the art that the present invention may be embodied in many other specific forms without departing from the spirit or scope of the invention. Particularly, it should be understood that the present invention may be embodied in the following forms.

Figure 6:
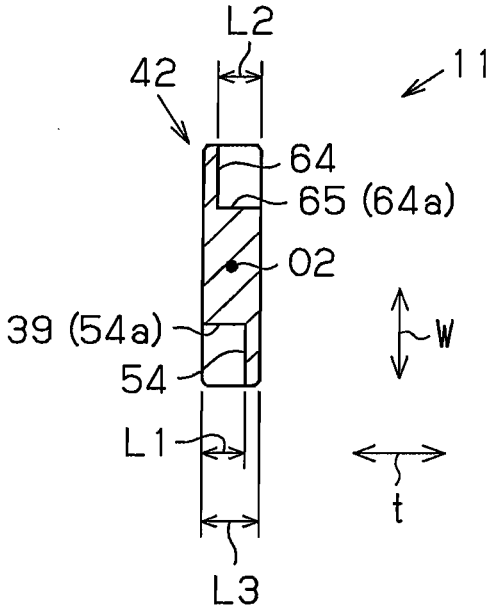
FIG. 6 is a cross-sectional view of a key according to a further embodiment of the present invention.

In the first embodiment, the key 11 is formed so that the sum of the depth of the first notch 54 (dimension L1) and the depth of the second notch 64 (dimension L2) is equal to the thickness (dimension L3) of the blade 42. However, as shown in FIG. 6, the key 11 may be formed so that the sum of the depth of the first notch 54 (dimension L1) and the depth of the second notch 64 (dimension L2) is greater than the thickness (dimension L3) of the blade 42. In this case, dimension L1 is less than dimension L3, and dimension L2 is less than dimension L3. The second embodiment may also be modified in the same manner.

In the first embodiment, the dimension L1 and the dimension L2 are equal to each other. However, the dimensions L1 and L2 do not have to be the same. Likewise, in the second embodiment, the dimension D1 and the dimension D2 are equal to each other. However, the dimensions D1 and D2 do not have to be the same.

In the first embodiment, the two serrations 39 and 65 are symmetric about the center line O2. However, the serrations 39 and 65 do not have to be symmetric. More specifically, the first serrations 39 and the second serrations 65 may be shaped differently. In this case, the number of plate tumblers retained in the cylinder lock 12 is increased from eight to sixteen. Eight plate tumblers engage the first serrations 39 and the remaining eight plate tumblers engage the second serrations 65. Such a key is not reversible. However, the security level of the key is increased since it is more difficult to duplicate.

In the key 11 of the first embodiment, the two serrations 39 and 65 are shaped in correspondence with the plate tumblers 21-28 of the cylinder lock 12. However, the serrations 39 and 65 may be shaped in correspondence with pin tumblers of a cylinder lock.

In the key 71 of the second embodiment, the first notch 76 is defined between two walls, with the first serrations 39 formed along the wall (serrated wall 76*a*) that is closer to the second narrow side 75. However, serrations may also be formed on the other wall of the first notch 76 that is closer to the first narrow side 74. Alternatively, the first serrations 39 may be eliminated, and serrations may be formed on only the wall of the first notch 76 that is closer to the first narrow side 74. The same modification may be made for the second notch 86 of the key 71.

In the first embodiment, the key 11 is made of metal. However, the key 11 may be made of any material such as a synthetic resin. The key 71 of the second embodiment may also be made of any material such as a synthetic resin.

The present examples and embodiments are to be considered as illustrative and not restrictive, and the invention is not to be limited to the details given herein, but may be modified within the scope and equivalence of the appended claims.

The invention claimed is:

1. A key for insertion into an associated cylinder lock including a rotor and a plurality of tumblers retained in the rotor, the key comprising:

a single flat blade insertable into the rotor of the cylinder lock, wherein the blade has a thickness and a width, the blade including:

a first wide side;

a second wide side located opposite to the first wide side in a thicknesswise direction of the blade;

a first narrow side connecting the first and second wide sides;

a second narrow side located opposite to the first narrow side in a widthwise direction of the blade and connecting the first and second wide sides;

a first notch formed in the first wide side near the first narrow side and extending in an insertion direction of the blade, wherein the first notch has a depth in the thicknesswise direction and is defined by a serrated wall and a bottom wall intersecting the serrated wall, the bottom wall extends continuously in the insertion direction of the blade, and the serrated wall of the first notch is engageable with the tumblers retained in the rotor of the cylinder lock in the widthwise direction;

a second notch formed in the second wide side near the second narrow side and extending in the insertion direction of the blade, wherein the second notch has a depth in the thicknesswise direction and is defined by a serrated wall and a bottom wall intersecting the serrated wall, and the serrated wall of the second notch is engageable with the tumblers retained in the rotor of the cylinder lock in the widthwise direction;

wherein the first notch and the second notch are completely spaced apart from each other in the widthwise direction without any overlapping portions in the thicknesswise direction and do not entirely overlap one another when viewed from a direction perpendicular to the first wide side, and a sum of the depth of the first notch and the depth of the second notch is greater than the thickness of the blade;

a first edge located between the first wide side and the second narrow side;

a second edge located between the second wide side and the first narrow side;

a third edge located between the first wide side and the serrated wall of the first notch, wherein the first and third edges are connected by a continuously straight and flat surface at the first wide side;

a fourth edge located between the second wide side and the serrated wall of the second notch, wherein the second and fourth edges are connected by a continuously straight and flat surface at the second wide side;

a fifth edge located between the first narrow side and the bottom wall of the first notch, wherein the second and fifth edges are connected by a continuously flat surface at the first narrow side; and a sixth edge located between the second narrow side and the bottom wall of the second notch, wherein the first and sixth edges are connected by a continuously flat surface at the second narrow side;

wherein the depth of the first notch is measured from the third edge to the bottom wall of the first notch that intersects the fifth edge, the depth of the second notch is measured from the fourth edge to the bottom wall of the second notch that intersects the sixth edge, and the thickness of the blade is measured between an outermost portion of the first wide surface extending along the corresponding continuously straight and flat surface and outermost portion of the second wide surface extending along the corresponding continuously straight and flat surface.

2. The key according to claim 1, wherein the first notch and the second notch are symmetric to each other.

3. The key according to claim 1, wherein the blade further includes:

a first flange extending between the first narrow side and the first notch in the first wide side; and a second flange extending between the second narrow side and the second notch in the second wide side.

4. A lock comprising:

a cylinder having a slot;

a rotatable rotor received in the cylinder;

a plurality of movable tumblers retained in the rotor;

a plurality of springs retained in the rotor for urging the tumblers to project out of the rotor and into the slot of the cylinder; and a key formed from a single flat blade insertable into the rotor, wherein the blade has a thickness and a width, the blade including:

a first wide side;

a second wide side located opposite to the first wide side in a thicknesswise direction of the blade;

a first narrow side connecting the first and second wide sides;

a second narrow side located opposite to the first narrow side in a widthwise direction of the blade and connecting the first and second wide sides;

a first notch formed in the first wide side near the first narrow side and extending in an insertion direction of the blade, wherein the first notch has a depth in the thicknesswise direction and is defined by a serrated wall and a bottom wall intersecting the serrated wall, the bottom wall extends continuously in the insertion direction of the blade, and the serrated wall of the first notch is engageable with the tumblers in the widthwise direction and shaped to move the tumblers out of the slot and into the rotor against the force of the springs when engaged with the tumblers during insertion of the blade into the rotor;

a second notch formed in the second wide side near the second narrow side and extending in the insertion direction of the blade, wherein the second notch has a depth in the thicknesswise direction and is defined by a serrated wall and a bottom wall intersecting the serrated wall, and the serrated wall of the second notch is engageable with the tumblers in the widthwise direction and shaped to move the tumblers out of the slot and into the rotor against the force of the springs when engaged with the tumblers during insertion of the blade into the rotor;

wherein the first notch and the second notch are completely spaced apart from each other in the widthwise direction without any overlapping portions in the thicknesswise direction and do not entirely overlap one another when viewed from a direction perpendicular to the first wide side, and a sum of the depth of the first notch and the depth of the second notch is greater than the thickness of the blade;

a first edge located between the first wide side and the second narrow side;

a second edge located between the second wide side and the first narrow side;

a third edge located between the first wide side and the serrated wall of the first notch, wherein the first and third edges are connected by a continuously straight and flat surface at the first wide side;

a fourth edge located between the second wide side and the serrated wall of the second notch, wherein the second and fourth edges are connected by a continuously straight and flat surface at the second wide side;

a fifth edge located between the first narrow side and the bottom wall of the first notch, wherein the second and fifth edges are connected by a continuously flat surface at the first narrow side; and a sixth edge located between the second narrow side and the bottom wall of the second notch, wherein the first and sixth edges are connected by a continuously flat surface at the second narrow side;

wherein the depth of the first notch is measured from the third edge to the bottom wall of the first notch that intersects the fifth edge, the depth of the second notch is measured from the fourth edge to the bottom wall of the second notch that intersects the sixth edge, and the thickness of the blade is measured between an outermost portion of the first wide surface extending along the corresponding continuously straight and flat surface and outermost portion of the second wide surface extending along the corresponding continuously straight and flat surface.

5. The lock according to claim 4, wherein the first notch and the second notch are symmetric to each other.

6. The lock according to claim 4, wherein the blade further includes:

a first flange extending between the first narrow side and the first notch in the first wide side; and a second flange extending between the second narrow side and the second notch in the second wide side.

* * * * *